US010512916B2

(12) United States Patent
Szczelina et al.

(10) Patent No.: US 10,512,916 B2
(45) Date of Patent: Dec. 24, 2019

(54) CRUSHERS HAVING ADJUSTABLE ECCENTRICITY

(71) Applicants: ThyssenKrupp Industrial Solutions AG, Essen (DE); ThyssenKrupp AG, Essen (DE)

(72) Inventors: Piotr Szczelina, Beckum (DE); Guido Leuschen, Bielefeld (DE); Detlef Papajewski, Bochum (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 638 days.

(21) Appl. No.: 15/114,946

(22) PCT Filed: Jan. 30, 2015

(86) PCT No.: PCT/EP2015/000182
§ 371 (c)(1),
(2) Date: Jul. 28, 2016

(87) PCT Pub. No.: WO2015/113771
PCT Pub. Date: Aug. 6, 2015

(65) Prior Publication Data

US 2016/0346785 A1 Dec. 1, 2016

(30) Foreign Application Priority Data

Jan. 31, 2014 (DE) ..... 10 2014 101 240

(51) Int. Cl.
*B02C 2/02* (2006.01)
*B02C 2/00* (2006.01)
(Continued)

(52) U.S. Cl.
CPC ..... *B02C 2/02* (2013.01); *B02C 1/025* (2013.01); *B02C 2/00* (2013.01); *B02C 2/04* (2013.01);
(Continued)

(58) Field of Classification Search
CPC .. B02C 2/02; B02C 2/04; B02C 2/042; B02C 2/00; B02C 2/045; B02C 2/047
(Continued)

(56) References Cited

U.S. PATENT DOCUMENTS 2,021,895 A * 11/1935 Newhouse ..... B02C 2/06 241/211
2,147,833 A * 2/1939 Fahrenwald ..... B02C 2/04 241/215
(Continued)

FOREIGN PATENT DOCUMENTS

CN 1946481 A 4/2007
CN 102006938 A 4/2011
(Continued)

OTHER PUBLICATIONS

International Search Report for PCT/EP2015/000182 dated Apr. 16, 2015 (dated Apr. 23, 2015).
(Continued)

*Primary Examiner* — Adam J Eiseman
*Assistant Examiner* — Bobby Yeonjin Kim
(74) *Attorney, Agent, or Firm* — thyssenkrupp North America, Inc.

(57) ABSTRACT

A crusher may include a crushing member that is driven in an operatively connected manner by way of an eccentric element such that material to be crushed can be comminuted by way of a crushing movement generated at least in part by the eccentric element. At least one eccentric bushing may be connected by way of an active surface to the eccentric
(Continued)

element by way of frictional engagement. The eccentric bushing may have a pressure medium chamber that uses pressure to vary the frictional engagement between the eccentric element and the eccentric bushing. In some examples, the crusher may be of a jaw type or a cone type.

13 Claims, 3 Drawing Sheets

(51) Int. Cl.
*B02C 2/04* (2006.01)
*B02C 1/02* (2006.01)

(52) U.S. Cl.
CPC ..... *B02C 2/042* (2013.01); *B02C 2/045* (2013.01); *B02C 2/047* (2013.01)

(58) Field of Classification Search
USPC ..... 241/208, 209, 214, 215
See application file for complete search history.

(56) References Cited

U.S. PATENT DOCUMENTS 2,921,750 A * 1/1960 Picalarga ..... B02C 1/04 241/267
3,118,623 A * 1/1964 Johnson ..... B02C 2/04 241/207
3,782,647 A * 1/1974 Decker ..... B02C 2/047 241/215
3,801,026 A * 4/1974 Decker ..... B02C 2/047 241/211
3,944,146 A * 3/1976 Stockmann ..... B02C 2/047 241/30
4,034,922 A * 7/1977 Coxhill ..... B02C 2/06 241/213
4,410,145 A * 10/1983 Koch ..... B02C 1/005 241/207
8,181,895 B2 * 5/2012 Kuvaja ..... B02C 2/04 241/207
2011/0095110 A1 4/2011 Kuvaja
2014/0048636 A1 * 2/2014 Zhu ..... B02C 1/04 241/267
2018/0369822 A1 * 12/2018 Fredriksson ..... B02C 2/042

FOREIGN PATENT DOCUMENTS

CN 201807389 U 4/2011
EP 2689851 A1 1/2014
WO 00/21673 A1 4/2000
WO 2010/002338 A1 1/2010

OTHER PUBLICATIONS

English abstract of CN1946481A.
English abstract of CN201807389U.

* cited by examiner

CRUSHERS HAVING ADJUSTABLE ECCENTRICITY

CROSS REFERENCE TO RELATED APPLICATIONS

This application is a U.S. National Stage Entry of International Patent Application Serial Number PCT/EP2015/000182, filed Jan. 30, 2015, which claims priority to German Patent Application No. DE 10 2014 101 240.2 filed Jan. 31, 2014, the entire contents of both of which are incorporated herein by reference.

FIELD

The present disclosure relates to crushers and, more particularly, to crushers with an eccentric element that helps generate crushing movements.

BACKGROUND

U.S. Pat. No. 8,181,895 B2 has disclosed a crusher having an adjustable eccentric unit, such that, in a manner dependent on the setting of the eccentric unit, the crushing member can perform crushing movements of different magnitudes. The crusher has a crushing cone which is seated on a cone axle, and the greater the eccentricity of the illustrated eccentric unit composed of a main eccentric bushing and an adjustment eccentric bushing, the greater the deflection of the cone axle from a machine central axis. In the case of relatively great deflection of the cone axle from the machine central axis, the crushing cone travels with a greater encircling crushing movement toward a crusher funnel, and the attainable grain size to which the material for crushing in the crusher can be reduced can be set by way of the eccentricity of the eccentric unit.

The setting is performed by way of an adjustment unit which acts by way of two concentrically running shafts on two pinions. Here, one pinion acts on the main eccentric bushing, and a further pinion acts on the adjustment eccentric bushing, wherein the two eccentric elements are fitted coaxially one inside the other and give rise to a variable crushing movement of the cone axle. Said movement corresponds to a wobbling movement, and the deflection in the wobbling movement can be set in a manner dependent on the rotational orientation of the two concentric eccentric bushings relative to one another. It is however disadvantageously necessary for the adjustment unit, which acts on the shafts for the respective drive of the eccentric bushings, to be permanently monitored. Furthermore, the construction with a hollow shaft and with a further shaft led through the hollow shaft is made up of numerous details, which are in particular susceptible to faults, and two toothings are necessary, which perform, and must adhere to, a transmission of torques and mutual phase positions, which are correspondingly to be set, from the shafts to the eccentric bushings.

DETAILED DESCRIPTION

Figure 1:
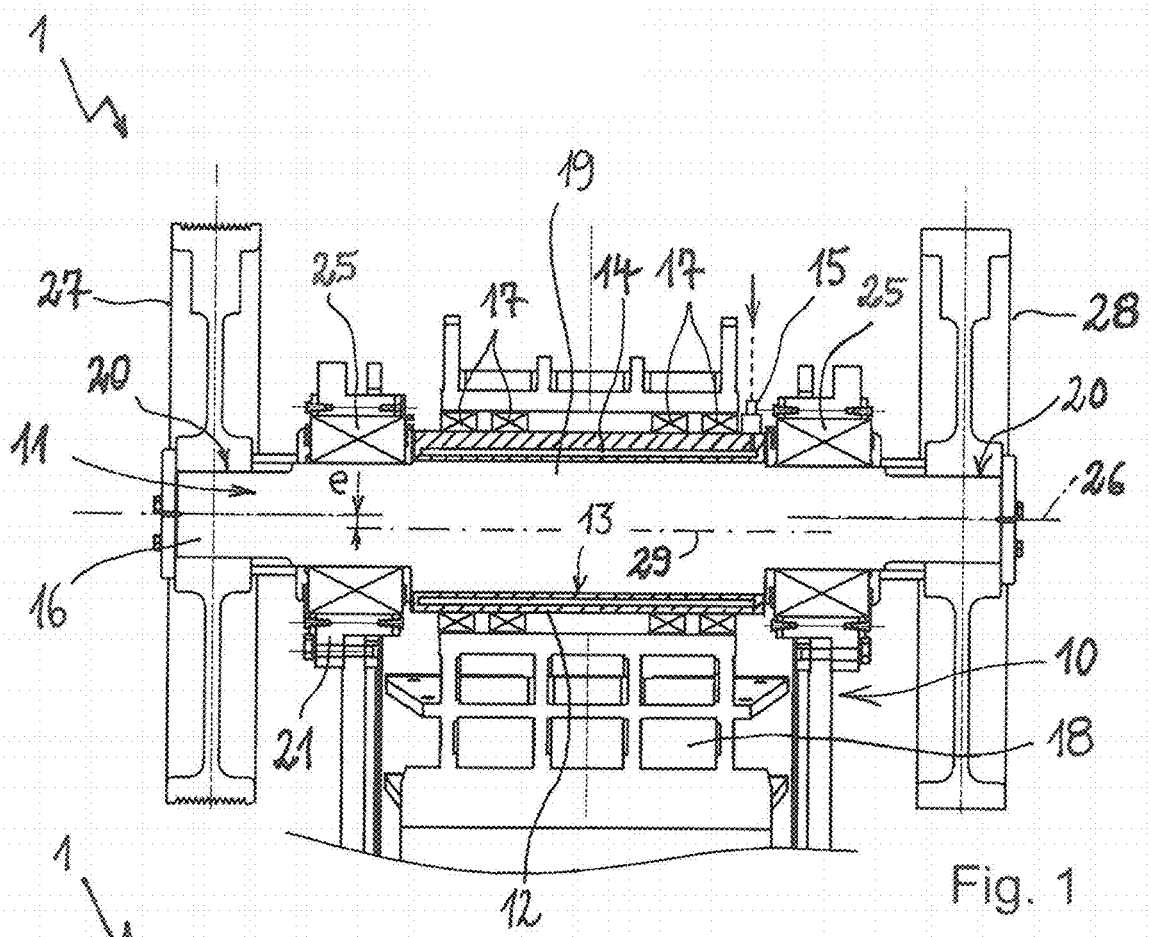
FIG. 1 is a sectional view of an example jaw-type crusher having an example eccentric bushing disposed between an example eccentric shaft and an example crushing jaw.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure generally concerns crushers that may include a crushing member that is driven in an operatively connected manner by way of an eccentric element such that material for crushing that can be introduced into the crusher can be comminuted by way of a crushing movement of the crushing member that can be generated by way of the eccentric element.

It is an object of the invention to further develop a crusher having a crushing member which is driven in an operatively connected manner by way of an eccentric element, wherein the crushing movement that can be generated in the crushing member should be easily variable. In particular, it should be possible for the crusher to be designed as a jaw-type crusher or as a cone-type crusher, such that the crushing member forms either a crushing jaw or a crushing cone.

The invention encompasses the technical teaching whereby at least one eccentric bushing is provided which is connected by way of an active surface to the eccentric element by way of frictional engagement, and wherein the eccentric bushing has a pressure medium chamber which is formed into the eccentric bushing such that, when the pressure medium chamber is pressurized, the frictional engagement between the eccentric element and the eccentric bushing can be varied.

The invention advantageously utilizes the possibility of establishing, releasing or adjusting, for the purposes of transmitting a particular torque, a frictionally engaging connection between the eccentric bushing and the eccentric element using a hydraulic pressurization of the pressure medium chamber. If it is sought to adjust the eccentric element relative to the eccentric bushing, for example when the crusher is at a standstill, it is possible for a corresponding adjustment means to be provided for this purpose, and when the desired rotational position of the eccentric element relative to the eccentric bushing has been set, the pressure medium chamber is charged with pressure medium, for example with pressure oil. The charging of the pressure medium chamber gives rise to a breathing movement of the in particular cylindrical, internally situated active surface of the eccentric bushing, which is in contact with the eccentric element. Said breathing movement gives rise to an elastic variation of the contour of the eccentric bushing, and the frictional engagement with respect to the eccentric bushing can be established and varied even by way of a minimal change of the contour.

The advantage of the arrangement according to the invention lies in the simple implementation of the adjustment of the eccentric bushing relative to the eccentric element, because, simply by varying the pressurization of the pressure medium chamber, the frictional engagement can be varied, and in particular reduced to the value zero, in order to perform the adjustment. For example, the connection may be eliminated when the pressure medium chamber is relieved of pressure, and the connection may be established when the pressure medium chamber is charged with pressure medium. In particular, the further advantage is achieved that the frictional engagement forms a type of overload prevention means, for example if maximum action forces of the crushing member on the material for crushing are exceeded. As a result of the change of the rotational position of the eccentric element relative to the eccentric bushing, the resulting eccentricity of the unit composed of eccentric element and eccentric bushing can be varied, such that, in this way, the crushing movement of the crushing member that can be generated can be increased or decreased.

The embodiment according to the invention of the eccentric bushing with a pressure medium chamber operatively connected to the eccentric element thus also forms an overload prevention means, and, in the event of maximum admissible operating forces being exceeded, the pressure medium chamber can for example be released of pressure, whereby the eccentricity of the unit composed of eccentric bushing and eccentric element can likewise change abruptly, with it being possible in particular for the eccentricity to be reduced, in order that the crushing forces, which are dependent on the magnitude of the crushing movement, are reduced as far as possible without a delay.

It is thus possible, between the eccentric bushing and the eccentric element, for the frictional engagement between the eccentric element and the eccentric bushing to be increased by way of an increase of the pressure of the pressure medium in the pressure medium chamber, and in the same way, the frictional engagement between the eccentric element and the eccentric bushing can be decreased by way of a reduction of the pressure of the pressure medium in the pressure medium chamber. In particular, frictional engagement can be established which is of a magnitude configured such that the arrangement composed of eccentric element and eccentric bushing forms an overload prevention means in order to prevent damage, in particular to the crushing member of the crusher.

For example, a closure member may be provided, by way of which the pressure of the pressure medium in the pressure medium chamber is held, and the closure member may be designed so as to open in the event of an exceedance of a maximum pressure of the pressure medium. The closure member may for example be of mechanical design; in particular, the closure member may form a valve. It is however alternatively also possible, for example, for a monitoring means to be provided instead of a closure member, which monitoring means is for example of electrical design and, by way of a corresponding monitoring member, monitors the action forces acting between the eccentric element and the eccentric bushing. In the event of maximum admissible action forces being exceeded, in particular in conjunction with the resultant forces on the crushing member of the crusher, a closure member can be electrically opened in order to relieve the pressure medium chamber of pressure. The drive unit of the crusher may for example also be deactivated in the same way.

It is particularly advantageously possible for the eccentric element and the eccentric bushing to be designed to be fitted one inside the other, and to each have eccentricities which are coordinated with one another such that the movement travel of the crushing member during a rotation of the eccentric element relative to the eccentric bushing can be changed. In particular, the eccentric bushing can assume a rotational position relative to the eccentric element such that the minimum value of the movement travel of the crushing member assumes a value zero. Crushers with crushing members may be designed in a variety of ways, and crushers are known which are designed as jaw-type crushers, and crushers are also known which are designed for example as cone-type crushers, wherein the adjustment arrangement according to the invention may be used in the case of jaw-type crushers, in the case of cone-type crushers or for example also in the case of eccentric-drum-type crushers.

In the context of the present invention, the crusher may be in the form of for example a jaw-type crusher, wherein the eccentric element is formed by an eccentric shaft which is operatively connected to the eccentric bushing according to the invention. The eccentric shaft may for example act on the crushing member via a bearing arrangement with bearing elements, wherein the crushing member forms a crushing jaw, and wherein the eccentric bushing surrounds an eccentric section of the eccentric shaft and is seated in the bearing element. The eccentric bushing according to the invention having the pressure medium chamber can thus be received in the bearing arrangement which connects the eccentric shaft to the swing arm which forms the crushing member itself or which at least acts on the crushing member.

In a further design variant, the eccentric shaft may have bearing journals, wherein, on each bearing journal, there is seated an eccentric bushing according to the invention, by way of which the eccentric shaft is mounted in a machine frame. The bearing journals may for example laterally adjoin the eccentric section of the eccentric shaft, and the eccentric shaft can be mounted in the machine frame by way of the bearing journals. Here, each bearing journal may be assigned an eccentric bushing, and the bearing journal forms the eccentric element with a first eccentricity, which is seated in the eccentric bushing, which has a further eccentricity. By way of the pressurization of the pressure medium chamber, it is possible, during the operation of the crusher, for the rotational position of the eccentric bushing on the bearing journal to be fixed, wherein a release of pressure from the pressure medium chamber permits a rotation of the eccentric bushings on the bearing journals. In the same way, an overload prevention means is created, because an excessive increase of operating forces of the crusher has a direct effect on the pressure in the pressure medium chamber, such that the pressure in said pressure medium chamber can be released or at least reduced.

In a further possible embodiment, the crusher forms a cone-type crusher, wherein the eccentric element is formed by a main eccentric bushing which is operatively connected to the eccentric bushing according to the invention. The unit composed of eccentric bushing and main eccentric bushing in this case forms the adjustment arrangement, wherein the adjustment of the eccentric bushing relative to the main eccentric bushing does not have to be maintained by mechanical means, because the pressurization of the pressure medium chamber can be performed in static fashion.

The crusher, which is designed as a cone-type crusher, may have a cone axle which extends through the eccentric bushing, and wherein the eccentric bushing is seated in the main eccentric bushing, and wherein, finally, the main eccentric bushing itself is seated in the machine frame of the cone-type crusher. The arrangement and design of an eccentric bushing according to the invention may be used not only in a cone-type crusher but also in a gyratory crusher or in an eccentric-drum-type crusher.

The object of the present invention is also achieved by way of a method for adjusting the movement travel of a crushing member of a crusher, in particular of a jaw-type crusher or of a cone-type crusher, wherein the method has at least the following steps: placing the pressure medium chamber in an unpressurized state, rotating the eccentric element relative to the eccentric bushing, and pressurizing the pressure medium chamber. Said method steps may for example be performed whenever it is sought to perform an adjustment of the eccentricity of the unit composed of the eccentric bushing and the eccentric element.

The rotation of the eccentric element relative to the eccentric bushing may be performed by way of a mechanically and/or hydraulically and/or electrically acting rotation means. Said rotation means may for example also be operated manually, and when the pressure medium chamber has been charged with pressure medium, for example with pressure oil, again, the crusher can be set in operation in the conventional manner, without mechanical means having to be provided for permanently maintaining and/or monitoring the rotational position of the eccentric bushing relative to the eccentric element.

The pressure medium chamber may be of encircling form in the eccentric bushing, such that the pressure medium chamber forms a hollow cavity in the manner of a tube section. In this way, the elastic deformation of the active surface of the eccentric bushing against the eccentric element is generated over the full circumference, such that no zones are formed which generate an uneven frictional engagement between the eccentric element and the eccentric bushing over the circumference. Alternatively, it is however also possible for multiple pressure medium chambers to be provided which are formed into the eccentric bushing in segmented fashion in limited circumferential regions, whereby it may be possible for the radial load capacity of the eccentric bushing to be increased. The pressure medium chamber may preferably have an axial length which corresponds approximately to the length of the eccentric element.

The frictional engagement that can be generated between the eccentric element and the eccentric bushing can be optimized, for example by virtue of a corresponding coating being applied to the active surface of the eccentric bushing or to the counterpart surface, which is in frictional engagement with the active surface, of the eccentric element.

Figure 2:
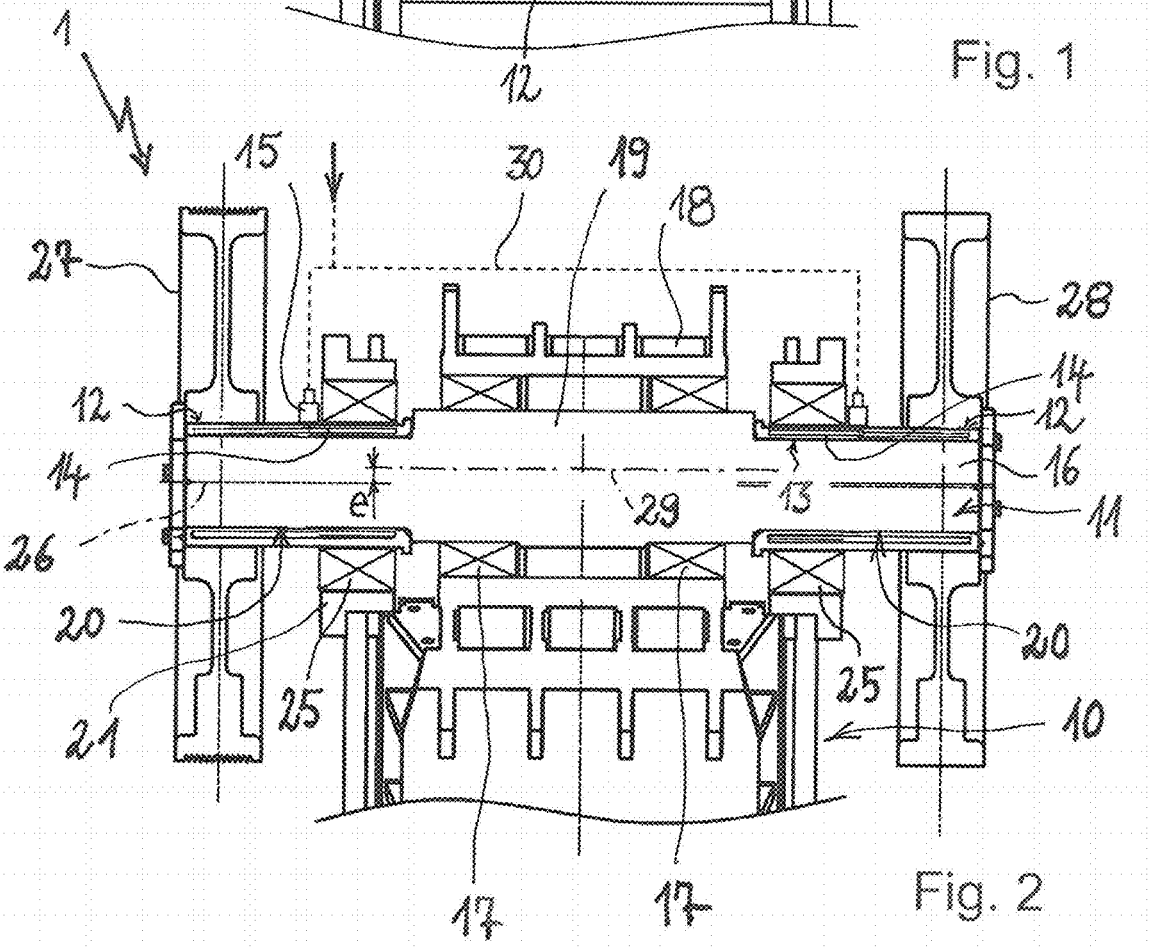
FIG. 2 is a sectional view of the jaw-type crusher of FIG. 1 wherein two eccentric bushings are disposed between the eccentric shaft and an example bearing arrangement of the eccentric shaft in an example machine frame.

FIGS. 1 and 2 each show an exemplary embodiment of a crusher 1 which is designed as a jaw-type crusher. The jaw-type crusher has a machine frame 21 in which an eccentric element 11 is rotatably mounted by way of bearing elements 25. The eccentric element 11 forms an eccentric shaft 16, and the eccentric shaft 16 has an eccentric section 19, which eccentric section is adjoined by bearing journals 20 which extend along a shaft axis 26.

By way of bearing elements 17, the eccentric shaft 16 is connected by way of the eccentric section 19 to a crushing jaw 18, which forms the crushing member 10 of the crusher 1. Owing to the eccentricity e between the shaft axis 26 and an eccentric axis 29 which, taking into consideration the outer circumferential surface of the eccentric bushing 12, forms a central axis of the eccentric section 19, a crushing movement is generated in the crushing jaw 18 when the eccentric shaft 16 is set in rotation about a shaft axis 26 in the machine frame 21. The eccentric shaft 16 can be driven via a drive wheel 27 which is seated on a bearing journal 20 of the eccentric shaft 16, and a further wheel is shown on the opposite bearing journal 20, which further wheel, like the drive wheel 27 itself, serves as flywheel 28.

FIG. 1 shows an exemplary embodiment of the crusher 1 with an eccentric bushing 12 which is adapted to the contour of the eccentric section 19 and which is thus seated by way of an active surface 13 on the eccentric section 19 of the eccentric shaft 16. The eccentric bushing 12 has, distributed over its circumference, a variable thickness, and can be rotated about an eccentric axis 29 by way of the eccentric section 19. The overall eccentricity, formed by the arrangement of the eccentric element 11 in the form of the eccentric shaft 16 with the eccentric section 19 and with the eccentric bushing 12, can thus be varied, such that the stroke of the crushing movement of the crushing member 10 can be set in a variable manner. To fix the eccentric bushing 12 on the eccentric element 11 in a desired rotational position, the eccentric bushing 12 has a pressure medium chamber 14 which adjoins the active surface 13. The pressure medium chamber 14 extends through the body of the eccentric bushing 12 over the full circumference, and when the pressure medium chamber 14 is charged with pressure oil, the active surface 13 is pressed, by way of an elastic deformation, against the outer circumferential surface of the eccentric section 19 of the eccentric shaft 16. In this way, frictional engagement is generated between the eccentric element 11 and the eccentric bushing 12. Said frictional engagement ensures that the eccentric bushing 12 co-rotates with the rotation of the eccentric shaft 16.

If it is sought to adjust the eccentricity e, the crusher 1 can firstly be deactivated in order that the pressure medium chamber 14 is placed in an unpressurized state. Subsequently, a rotation of the eccentric bushing 12 on the eccentric section 19 may be performed manually or by way of a corresponding device, before the pressure medium chamber 14 is subsequently charged with pressure oil again. In this way, an adjustment of the eccentricity e of the crusher 1 is made possible without relatively large adjustment devices.

FIG. 2 shows a design variant of the crusher 1, and two eccentric bushings 12 are provided, which are seated on the bearing journals 20 of the eccentric shaft 16. Here, by way of the bearing elements 17, the eccentric section 19 of the eccentric shaft 16 is connected directly to the crushing jaw 18, such that no adjustment is possible between the eccentric section 19 of the eccentric shaft 16 and the crushing jaw 18. If it is sought to adjust the eccentricity e, it is accordingly possible, after the pressure medium chambers 14 have been placed in an unpressurized state, for the eccentric bushings 12 to be rotated on the bearing journals 20 of the eccentric shaft 16, before the pressure medium chambers 14 are subsequently pressurized again and the crusher 1 is set in operation. Here, the eccentric bushings 12 likewise have a thickness which is variable over the circumference, such that the eccentricity e of the eccentric shaft 16 as a whole relative to the machine frame 21 can be varied. The exemplary embodiment here shows that the eccentric shaft 16 is mounted rotatably in the machine frame 21 by way of the eccentric bushings 12 in the bearing elements 25.

To hold the pressure of the pressure oil in the pressure medium chambers 14, closure members 15 are shown in the exemplary embodiments as per FIG. 1 and FIG. 2, which closure members are fluidically connected to the pressure medium chambers 14 of the eccentric bushings 12. The closure members 15 may for example be designed as safety valves, and if admissible crushing forces are exceeded during the operation of the crusher 1, the closure members 15 can open in order to place the pressure medium chambers 14 abruptly in an unpressurized state. As a result of the frictional engagement being eliminated, the eccentric bushings 12 are immediately rotated on the eccentric section 19 or on the bearing journals 20, whereby a safety device is realized. In the exemplary embodiment in FIG. 2, two eccentric bushings 12 are provided, and, by way of a connecting line 30, the pressure in the pressure medium chambers 14 can lie at the same level. Owing to the connecting line 30, it is possible, as shown, for equal pressurization of the pressure medium chambers 14 to be realized, wherein the pressure medium chambers 14 may also, in a manner not shown in any more detail, have a connecting line by way of which the pressure volumes of the pressure medium chambers 14 are directly connected to one another, without one of the illustrated closure members 15 being provided in the connecting line.

Figure 3:
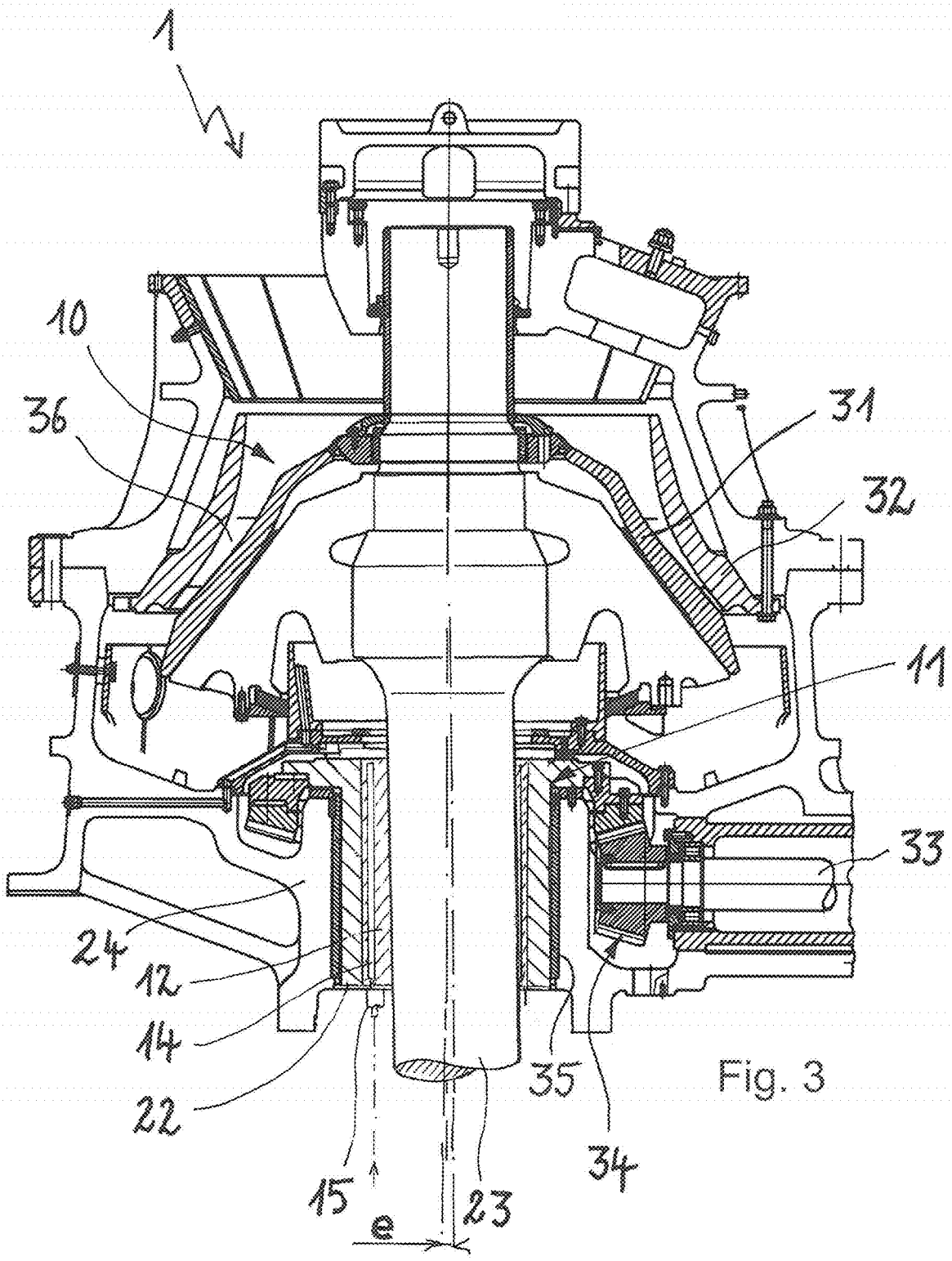
FIG. 3 is a sectional view of an example cone-type crusher having an example eccentric bushing operatively connected to an example main eccentric bushing at least for varying an eccentricity of a cone axle about a machine central axis in a machine frame.

FIG. 3 shows an exemplary embodiment of a crusher 1 which is designed as a cone-type crusher. The crushing member 10 of the cone-type crusher is formed by a crushing cone 31, which is held on a cone axle 23 and which is seated in a crusher funnel 32 such that a crushing gap 36 is formed. Owing to an eccentricity e, the cone axle 23 wobbles about a spatially fixed machine central axis when the cone axle 23 is driven by way of a drive shaft 33 and by way of a toothing 34. Here, the toothing 34 exerts a driving action on an eccentric element 11, which is mounted rotatably in a machine frame 24 of the crusher 1 by way of a slide bushing 35, and the eccentric element 11 forms a main eccentric bushing 22 in the form of a tubular section.

According to the invention, there is seated in the inside of the tubular section of the main eccentric bushing 22 an eccentric bushing 12 through which the cone axle 23 extends. The tubular section of the main eccentric bushing 22 has, over the circumference, a changing thickness, and in the same way, the eccentric bushing 12 has, distributed over the circumference, a changing thickness. Consequently, the resultant eccentricity e for generating the crushing movement of the crushing cone 31 can be varied by virtue of the rotational position of the eccentric bushing 12 relative to the main eccentric bushing 22 being varied.

In the eccentric bushing 12 there is situated a pressure medium chamber 14 which can be charged with pressure oil via a closure member 15. A pressurization of the pressure medium chamber 14 causes an externally situated active surface 13 of the eccentric bushing 12 to be pressed against the inner side of the tubular section of the main eccentric bushing 22, whereby frictional engagement is established between the eccentric bushing 12 and the eccentric element 11.

To vary the eccentricity e, it is possible, in particular when the crusher 1 is at a standstill, for the pressure medium chamber 14 to be placed in an unpressurized state by way of the closure member 15, and subsequently, a rotation of the eccentric bushing 12 in the tubular section of the main eccentric bushing 22, which forms the eccentric element 11, may be performed. A re-pressurization of the pressure medium chamber 14 causes the frictional engagement between the eccentric bushing 12 and the main eccentric bushing 22 to be restored as a result of the active surface 13 being pressed against the inner side of the tubular section of the main eccentric bushing 22, and the set eccentricity e can be utilized to generate the crushing movement of the crushing cone 31, by way of the cone axle 23, with a desired magnitude.

The closure member 15 may be designed as a safety valve, and if the crushing forces exceed admissible values, the closure member 15 can abruptly open and place the pressure medium chamber 14 in an unpressurized state. In this way, an immediate rotation of the eccentric bushing 12 in the eccentric element 11 occurs, such that the eccentricity e can be reduced, or the eccentricity e assumes the value zero, depending on the rotational position of the eccentric bushing 12 on the eccentric element 11.

Figure 4:
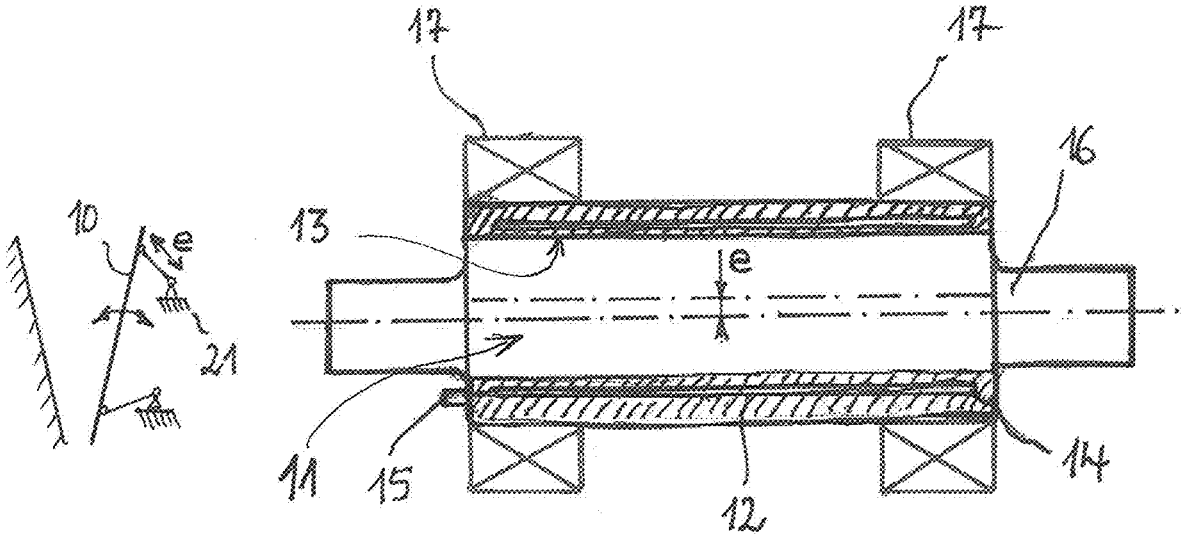
FIG. 4 is a schematic view of an example eccentric shaft and an example eccentric bushing in an arrangement of bearing elements with a corresponding diagram.

FIG. 4 shows, in a schematic view, the arrangement of an eccentric element 11 which forms, for example, the eccentric shaft 16 as per the exemplary embodiment in FIG. 1. Situated in the radial intermediate space between the bearing elements 17 and the eccentric shaft 16 is the eccentric bushing 12 with the pressure medium chamber 14, and it is shown that the pressure medium chamber 14 extends, in the form of a tubular sleeve, over the length of the eccentric shaft 16. On the inside, the eccentric bushing 12 has an active surface 13, and if the pressure medium chamber 14 is pressurized by the closure element 15, the active surface 13 can perform a breathing movement, such that the internally situated active surface 13 is reduced in diameter slightly and pressed against the outer side of the eccentric shaft 16. As a result, frictional engagement is generated, which can assume such high values that a required torque can be transmitted from the eccentric shaft 16 via the eccentric bushing 12 to the bearing elements 17.

Illustrated on the left-hand side is an equivalent diagram in which the eccentricity e is indicated, and the eccentric shaft 16 forms, with the eccentric bushing 12, a connecting link between a static machine frame 21 and the moving crushing member 10, and it can be seen that, by way of an adjustment of the eccentricity e, the crushing movement of the crushing member 10 can likewise be changed.

Figure 5:
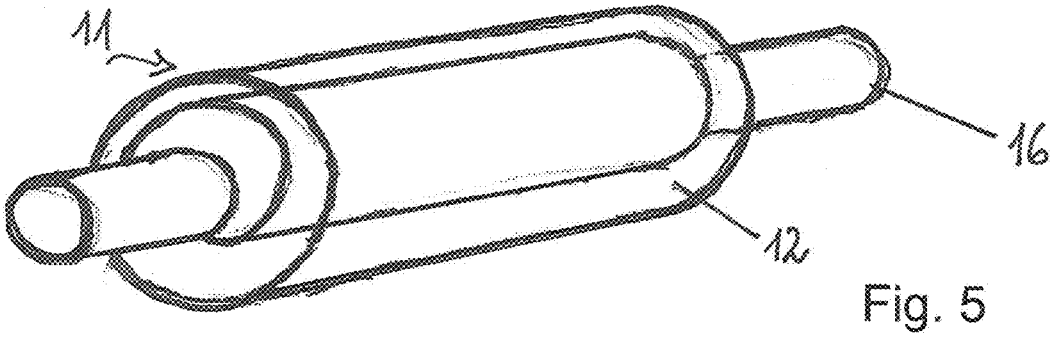
FIG. 5 is a perspective view of an example eccentric shaft in partially transparent form.

FIG. 5 shows, in an abstracted view, the eccentric shaft 16 as per the exemplary embodiment in FIG. 1, and the eccentric bushing 12 is seated on the eccentric shaft 16 and is shown in partially transparent form, wherein the eccentric shaft 16 forms, by way of example, the eccentric element 11.

Figure 6:
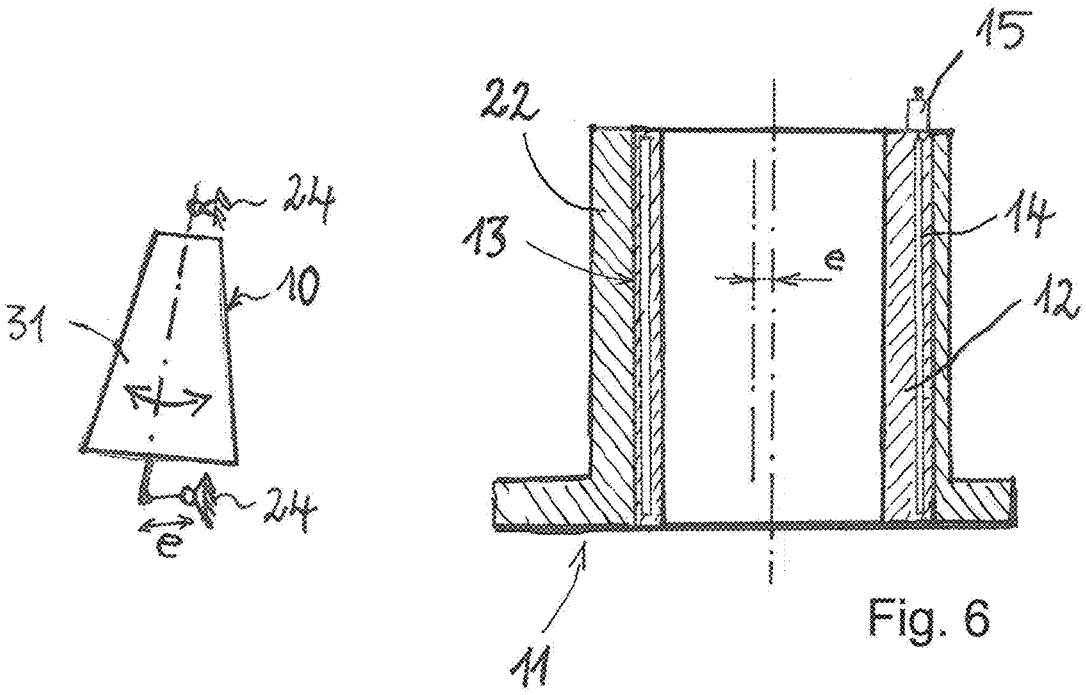
FIG. 6 is a sectional view of an example main eccentric bushing with an example eccentric bushing and a corresponding diagram.

Finally, FIG. 6 shows a schematic view of the eccentric element 11 in the form of the main eccentric bushing 22 as per the exemplary embodiment in FIG. 3, and the eccentric bushing 12 is seated on the inside of the tubular section of the main eccentric bushing 22, wherein said arrangement may be used for example in a cone-type crusher. The sectional view shows different wall thicknesses of the tubular section of the main eccentric bushing 22 and of the eccentric bushing 12, which can be rotated relative to one another such that the eccentricity e can be increased or decreased. Situated at the inside under the active surface 13 is the pressure medium chamber 14 which, when pressurized, can brace the active surface 13 against the inner side of the main eccentric bushing 22 by way of a slight elastic deformation.

Thus, in this exemplary embodiment, the illustrated pressure medium chamber 14 in the eccentric bushing 12 acts on an externally situated active surface 13, which can elastically deform such that a small gap between the active surface 13 and the inner side of the tubular section of the main eccentric bushing 22 can be overcome, and frictional engagement can be generated between the active surface 13 and the main eccentric bushing 22, which frictional engagement permits a transmission of a corresponding torque by virtue of the outer diameter of the eccentric bushing 12 being enlarged as a result of an elastic deformation of the active surface 13.

The equivalent diagram on the left-hand side shows a crushing member 10 in the form of a crushing cone 31, which is connected by way of a connecting link to the static machine frame 24. If the eccentricity e is varied, the length of the connecting link varies, and the deflection of the crushing cone 31 in the machine frame 24 can generate a change in the crushing movement of the crushing member 10.

The invention is not restricted in terms of its embodiment to the preferred exemplary embodiment specified above. Rather, numerous variants are conceivable which make use of the illustrated solution even in the case of fundamentally different embodiments. All of the features and/or advantages that emerge from the claims, from the description or from the drawings, including structural details or spatial arrangements, may be essential to the invention both individually and in a wide variety of combinations.

What is claimed is:

1. A crusher comprising:

an eccentric element;

a crushing member that is driven in an operatively connected manner by way of the eccentric element such that material introduced into the crusher is comminuted by way of a crushing movement of the crushing member that is generated at least in part by way of the eccentric element; and an eccentric bushing comprising a pressure medium chamber formed therein, the eccentric bushing connected by way of an active surface to the eccentric element by way of frictional engagement, wherein the frictional engagement between the eccentric element and the eccentric bushing varies as a function of pressure of a pressure medium in the pressure medium chamber of the eccentric bushing.

2. The crusher of claim 1, wherein an increase in the pressure in the pressure medium chamber increases the frictional engagement between the eccentric element and the eccentric bushing, wherein a decrease in the pressure in the pressure medium chamber decreases the frictional engagement between the eccentric element and the eccentric bushing.

3. The crusher of claim 1, further comprising a closure member for holding the pressure of the pressure medium chamber, wherein the closure member is configured to open when a maximum pressure in the pressure medium chamber is exceeded.

4. The crusher of claim 1, wherein the eccentric element and the eccentric bushing are configured to be fitted one inside the other, wherein eccentricities of the eccentric element and the eccentric bushing permit the eccentric element and the eccentric bushing to cooperate with one another such that a movement of travel of the crushing member during a rotation of the eccentric element relative to the eccentric bushing is adjustable.

5. The crusher of claim 4 wherein a minimum value of the movement of travel of the crushing member is zero.

6. The crusher of claim 1, wherein the crusher is a jaw crusher, wherein the eccentric element comprises an eccentric shaft that is operatively connected to the eccentric bushing.

7. The crusher of claim 6, wherein the eccentric shaft acts on the crushing member via a bearing arrangement with bearing elements, wherein the crushing member comprises a crushing jaw, wherein the eccentric bushing surrounds an eccentric section of the eccentric shaft and is seated in the bearing elements.

8. The crusher of claim 6, wherein the eccentric shaft comprises bearing journals, wherein the eccentric bushing is seated on each of the bearing journals, by way of which the eccentric shaft is mounted in a machine frame.

9. The crusher of claim 6, wherein the crusher is a cone-type crusher, wherein the eccentric element comprises a main eccentric bushing that is operatively connected to the eccentric bushing.

10. The crusher of claim 6, further comprising a cone axle that extends through the eccentric bushing, wherein the eccentric bushing is seated in the main eccentric bushing.

11. A method for adjusting a movement travel of the crushing member of the crusher recited in claim 1, wherein the crusher is of a cone crusher or of a jaw crusher, the method comprising:

placing the pressure medium chamber in an unpressurized state;

rotating the eccentric element relative to the eccentric bushing; and pressurizing the pressure medium chamber.

12. The method of claim 11 wherein the rotation of the eccentric element relative to the eccentric bushing occurs by mechanically, hydraulically, and/or electrically acting rotation means.

13. A method for adjusting a movement travel of a crushing member of a crusher of a jaw crusher or a cone crusher, wherein the crusher includes the crushing member driven by way of an eccentric element in an operatively connected and adjustable manner based on frictional engagement between the eccentric element and an eccentric bushing, the eccentric bushing comprising a pressure medium chamber formed therein, and wherein the the frictional engagement is a function of a pressure of a pressure medium in the pressure medium chamber of the eccentric bushing, the method comprising:

placing the pressure medium chamber in an unpressurized state;

rotating the eccentric element relative to the eccentric bushing; and pressurizing the pressure medium chamber.

* * * * *